US011002276B2

(12) United States Patent
Antimonov et al.

(10) Patent No.: US 11,002,276 B2
(45) Date of Patent: May 11, 2021

(54) COMPRESSOR HAVING BUSHING

(71) Applicant: Emerson Climate Technologies, Inc., Sidney, OH (US)

(72) Inventors: Mikhail A. Antimonov, Beavercreek, OH (US); Roy J. Doepker, Lima, OH (US); Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 16/252,997

(22) Filed: Jan. 21, 2019

(65) Prior Publication Data

US 2019/0345939 A1 Nov. 14, 2019

Related U.S. Application Data

(60) Provisional application No. 62/670,231, filed on May 11, 2018.

(51) Int. Cl.

| | |
|---|---|
| ***F04C 29/00*** | (2006.01) |
| ***F01C 21/02*** | (2006.01) |
| ***F04C 18/02*** | (2006.01) |

(52) U.S. Cl.

CPC ..... *F04C 29/0071* (2013.01); *F01C 21/02* (2013.01); *F04C 18/0215* (2013.01);

(Continued)

(58) Field of Classification Search

CPC ..... F04C 18/0215; F04C 29/0057; F04C 2240/50; F04C 2240/56; F01C 21/02; F01C 19/005; F16C 35/10; F16C 9/02

(Continued)

(56) References Cited

U.S. PATENT DOCUMENTS 4,300,875 A 11/1981 Fischer et al.
4,314,796 A 2/1982 Terauchi (Continued)

FOREIGN PATENT DOCUMENTS

CN 1186174 A 7/1998
CN 1249401 A 4/2000

(Continued)

OTHER PUBLICATIONS

Jeff Kerns, How to Pinpoint the Best Plain Bearing, Oct. 26, 2016, Machine Design (Year: 2016).*

(Continued)

*Primary Examiner* — Dominick L Plakkoottam
(74) *Attorney, Agent, or Firm* — Harness, Dickey & Pierce, P.L.C.

(57) ABSTRACT

A compressor may include a non-orbiting scroll, an orbiting scroll, a driveshaft and a bushing. The non-orbiting scroll includes a first end plate having a first spiral wrap extending therefrom. The orbiting scroll includes a second end plate having a first side and a second side. The first side has a second spiral wrap extending therefrom and meshingly engaged with the spiral wrap of the non-orbiting scroll. The second side has a hub extending therefrom. The driveshaft drivingly engaged to the orbiting scroll. The bushing supporting the driveshaft and is disposed within the hub of the orbiting scroll. One of the hub of the orbiting scroll and the bushing includes a convex portion.

23 Claims, 11 Drawing Sheets

(52) U.S. Cl.
CPC ..... *F04C 18/0253* (2013.01); *F04C 2240/30* (2013.01); *F04C 2240/40* (2013.01); *F04C 2240/54* (2013.01); *F04C 2240/56* (2013.01); *F04C 2240/60* (2013.01); *F04C 2240/605* (2013.01)

(58) Field of Classification Search
USPC ..... 418/55.1–55.5
See application file for complete search history.

(56) References Cited

U.S. PATENT DOCUMENTS 4,325,683 A 4/1982 Miyazawa
4,435,137 A 3/1984 Terauchi
4,702,683 A 10/1987 Inaba et al.
4,877,382 A 10/1989 Caillat et al.
4,993,928 A 2/1991 Fraser, Jr.
5,024,312 A * 6/1991 Godbersen ..... B60B 33/0028 193/37
5,186,546 A * 2/1993 Abe ..... F01C 21/02 384/206
5,295,813 A 3/1994 Caillat et al.
5,370,513 A 12/1994 Fain
5,378,129 A 1/1995 Dunaevsky et al.
5,407,334 A * 4/1995 Sano ..... F01C 21/02 418/55.1
5,520,524 A 5/1996 Takemoto et al.
5,520,527 A 5/1996 Kim
5,545,019 A 8/1996 Beck et al.
5,562,435 A 10/1996 Cho et al.
RE36,604 E * 3/2000 Sano ..... F01C 21/02 418/55.1
6,056,523 A 5/2000 Won et al.
6,079,962 A 6/2000 Seibel et al.
6,089,840 A 7/2000 Iizuka et al.
6,106,251 A 8/2000 Monnier et al.
6,139,294 A 10/2000 Haller
6,139,295 A 10/2000 Utter et al.
6,146,119 A 11/2000 Bush et al.
6,179,591 B1 * 1/2001 Clendenin ..... F04C 18/0253 418/55.1
6,189,248 B1 2/2001 Nagel et al.
6,193,489 B1 2/2001 Tarng et al.
6,273,616 B1 8/2001 Pflug
6,398,530 B1 6/2002 Hasemann
6,428,294 B1 8/2002 Fenocchi
6,454,551 B2 9/2002 Kuroki et al.
6,695,600 B2 2/2004 Koo et al.
6,709,247 B1 3/2004 Clendenin et al.
6,821,092 B1 11/2004 Gehret et al.
7,273,363 B1 9/2007 Sun et al.
7,338,263 B2 3/2008 Young
7,661,939 B2 2/2010 Su et al.
8,186,981 B2 5/2012 Sugimoto et al.
9,115,718 B2 8/2015 Ignatiev et al.
9,188,124 B2 11/2015 Utpat et al.
9,377,022 B2 6/2016 Ignatiev et al.
10,156,236 B2 12/2018 Utpat et al.
10,215,175 B2 2/2019 Ignatiev et al.
10,830,236 B2 11/2020 Ignatiev et al.
2002/0057975 A1 5/2002 Nakajima et al.
2002/0098102 A1 * 7/2002 Gennami ..... F04C 29/028 418/55.4
2003/0077193 A1 4/2003 Skinner
2004/0184931 A1 9/2004 Millet et al.
2005/0226755 A1 10/2005 Tsuchiya et al.
2007/0092390 A1 4/2007 Ignatiev et al.
2009/0246057 A1 10/2009 Sugimoto et al.
2009/0246059 A1 10/2009 Nakamura et al.
2010/0111709 A1 5/2010 Jayanth
2010/0166589 A1 * 7/2010 Iwano ..... F04C 29/0057 418/55.1
2011/0194966 A1 * 8/2011 Takeuchi ..... F04C 18/0253 418/55.2
2012/0257996 A1 10/2012 Smith
2012/0258003 A1 10/2012 Hahn
2014/0219850 A1 8/2014 Ignatiev et al.
2014/0294643 A1 * 10/2014 Koyama ..... F04C 29/0057 418/55.5
2014/0356209 A1 12/2014 Ignatiev et al.
2015/0361983 A1 12/2015 Ignatiev et al.
2016/0069348 A1 * 3/2016 Utpat ..... F04C 18/0215 418/55.1
2017/0037850 A1 2/2017 Ignatiev et al.
2017/0067508 A1 * 3/2017 Sawamoto ..... F16C 33/208
2017/0268340 A1 9/2017 Ootani et al.
2018/0023570 A1 * 1/2018 Huang ..... F04C 18/0215 418/55.4
2019/0316584 A1 10/2019 Antimonov et al.

FOREIGN PATENT DOCUMENTS

CN 1126871 C 11/2003
CN 1632317 A 6/2005
CN 101255864 A 9/2008
CN 101545483 A 9/2009
CN 101576072 A 11/2009
CN 101684811 A 3/2010
CN 102705235 A 10/2012
CN 203453056 U 2/2014
CN 203822627 U 9/2014
CN 107575380 A 1/2018
CN 107781160 A 3/2018
CN 107893757 A 4/2018
CN 210087600 U 2/2020
CN 210423002 U 4/2020
EP 1253323 B1 3/2005
JP S5896193 A 6/1983
JP 2000161256 A 6/2000
JP 2009114943 A 5/2009
JP 2012132409 A 7/2012
KR 20000006361 A 1/2000
KR 20090077294 A 7/2009
KR 100996628 B1 11/2010
WO WO-9410425 A1 5/1994
WO WO-2010113794 A1 10/2010
WO WO-2014155546 A1 10/2014
WO WO-2016031276 A1 3/2016
WO WO-2017057159 A1 4/2017

OTHER PUBLICATIONS

U.S. Appl. No. 14/832,371, filed Aug. 21, 2015, Kirill M. Ignatiev et al.
U.S. Appl. No. 16/253,030, filed Jan. 21, 2019, Mikhail A. Antimonov et al.
International Search Report regarding International Patent Application No. PCT/US2014/012319, dated Apr. 28, 2014.
Written Opinion of the International Searching Authority regarding International Application No. PCT/US2014/012319, dated Apr. 28, 2014.
Office Action regarding U.S. Appl. No. 14/159,526, dated Oct. 1, 2014.
Office Action regarding U.S. Appl. No. 14/159,526, dated Feb. 3, 2015.
Office Action regarding U.S. Appl. No. 13/869,567, dated Mar. 25, 2015.
Notice of Allowance regarding U.S. Appl. No. 14/159,526, dated Apr. 30, 2015.
Office Action regarding Chinese Patent Application No. 201310158952.1, dated May 5, 2015. Translation provided by Unitalen Attorneys at Law.
Notice of Allowance regarding U.S. Appl. No. 13/869,567, dated Sep. 22, 2015.
Office Action regarding Chinese Patent Application No. 201480005721.X, dated Jul. 15, 2016. Translation provided by Unitalen Attorneys at Law.
International Search Report regarding International Application No. PCT/US2016/045180, dated Oct. 12, 2016.

(56) References Cited

OTHER PUBLICATIONS

Written Opinion of the International Searching Authority regarding International Application No. PCT/US2016/045180, dated Oct. 12, 2016.
Office Action regarding Chinese Patent Application No. 201610157658.2, dated Sep. 26, 2017. Translation provided by Unitalen Attorneys at Law.
Restriction Requirement regarding U.S. Appl. No. 15/222,361, dated Jan. 11, 2018.
Office Action regarding U.S. Appl. No. 14/832,371, dated Feb. 1, 2018.
Office Action regarding Indian Patent Application No. 1344/MUM/2012, dated Feb. 12, 2018.
Office Action regarding U.S. Appl. No. 14/941,827, dated Mar. 15, 2018.
Office Action regarding U.S. Appl. No. 15/222,361, dated Apr. 17, 2018.
Office Action regarding Chinese Patent Application No. 201610157658.2, dated May 30, 2018. Translation provided by Unitalen Attorneys at Law.
Office Action regarding Chinese Patent Application No. 201710426869.6, dated Aug. 1, 2018. Translation provided by Unitalen Attorneys at Law.
Office Action regarding U.S. Appl. No. 14/832,371, dated Aug. 24, 2018.
Notice of Allowance regarding U.S. Appl. No. 14/941,827, dated Oct. 18, 2018.
Notice of Allowance regarding U.S. Appl. No. 15/222,361, dated Nov. 6, 2018.
Office Action regarding Chinese Patent Application No. 201680051384.7, dated Nov. 14, 2018. Translation provided by Unitalen Attorneys at Law.
Office Action regarding U.S. Appl. No. 14/832,371, dated Dec. 4, 2018.
Office Action regarding Korean Patent Application No. 10-2018-7005832, dated Feb. 18, 2019. Translation provided by KS KORYO International IP Law Firm.
Office Action regarding Chinese Patent Application No. 201910288717.3, dated Jun. 12, 2020. Translation provided by Unitalen Attorneys at Law.
Notice of Allowance regarding U.S. Appl. No. 14/832,371, dated Jul. 29, 2020.
Office Action regarding Chinese Patent Application No. 201910389798.6, dated Sep. 1, 2020. Translation provided by Unitalen Attorneys at Law.
Office Action regarding U.S. Appl. No. 16/253,030, dated Sep. 2, 2020.
Office Action regarding U.S. Appl. No. 14/832,371, dated Jun. 7, 2019.
Office Action regarding Korean Patent Application No. 10-2018-7005832, dated Jul. 17, 2019. Translation provided by KS KORYO International IP Law Firm.
Office Action regarding Chinese Patent Application No. 201680051384.7, dated Aug. 2, 2019. Translation provided by Unitalen Attorneys at Law.
Office Action regarding U.S. Appl. No. 14/832,371, dated Sep. 4, 2019.
Applicant-Initiated Interview Summary regarding U.S. Appl. No. 14/832,371, dated Nov. 26, 2019.
Office Action regarding U.S. Appl. No. 14/832,371, dated Feb. 13, 2020.
Office Action regarding Indian Patent Application No. 1344/MUM/2012, dated Sep. 30, 2020.

* cited by examiner

COMPRESSOR HAVING BUSHING

CROSS-REFERENCE TO RELATED APPLICATIONS

This application claims the benefit of U.S. Provisional Application No. 62/670,231, filed on May 11, 2018. The entire disclosure of the above application is incorporated herein by reference.

FIELD

The present disclosure relates to a compressor having a bushing.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a non-orbiting scroll, an orbiting scroll, a driveshaft and a bushing. The non-orbiting scroll includes a first end plate having a first spiral wrap extending therefrom. The orbiting scroll includes a second end plate having a first side and a second side. The first side has a second spiral wrap extending therefrom and meshingly engaged with the first spiral wrap of the non-orbiting scroll. The second side has a hub extending therefrom. The driveshaft is drivingly engaged to the orbiting scroll. The bushing may support the driveshaft and may be disposed within the hub of the orbiting scroll. Either the hub of the orbiting scroll or the bushing may include a convex portion.

In some configurations of the compressor of the above paragraph, the bushing includes the convex portion that contacts a middle portion of the hub.

In some configurations of the compressor of either of the above paragraphs, the bushing contacts the hub only at the convex portion.

In some configurations of the compressor of any of the above paragraphs, the bushing is disposed between the hub of the orbiting scroll and the driveshaft.

In some configurations of the compressor of any of the above paragraphs, a clearance gap exists between the hub and the bushing to allow for radial movement of the orbiting scroll relative to the bushing. The clearance gap extends only partially around an outer circumference of the bushing.

In some configurations of the compressor of any of the above paragraphs, the bushing includes an axially extending portion and a radially extending portion. The convex portion is formed on the axially extending portion of the bushing.

In some configurations of the compressor of any of the above paragraphs, a bearing housing including an annular recess formed in a surface thereof. A sealing member is received in the annular recess.

In some configurations of the compressor of any of the above paragraphs, the axially extending portion is disposed within the hub of the orbiting scroll between the hub and the driveshaft. The radially extending portion may extend radially from an axial end of the axially extending portion and may be disposed between an axial end of the hub and the surface of the bearing housing.

In some configurations of the compressor of any of the above paragraphs, the radially extending portion of the bushing engages the sealing member to seal a biasing chamber defined by the orbiting scroll, the non-orbiting scroll and the bearing housing.

In some configurations of the compressor of any of the above paragraphs, one of the axially extending portion and the hub includes an annular recess formed in a surface thereof, and wherein a sealing member is received in the annular recess.

In some configurations of the compressor of any of the above paragraphs, the other of the axially extending portion and the hub engages the sealing member to further seal the biasing chamber.

In some configurations of the compressor of any of the above paragraphs, a bearing housing includes an annular recess formed in a surface thereof, and wherein a sealing member is received in the annular recess.

In some configurations of the compressor of any of the above paragraphs, the bushing engages the sealing member to seal a biasing chamber defined by the orbiting scroll, the non-orbiting scroll and the bearing housing.

In some configurations of the compressor of any of the above paragraphs, the bushing includes an annular recess formed in a surface thereof, and wherein a sealing member is received in the annular recess.

In some configurations of the compressor of any of the above paragraphs, the second end plate of the orbiting scroll engages the sealing member to further seal the biasing chamber.

In some configurations of the compressor of any of the above paragraphs, the hub of the orbiting scroll includes the convex portion that contacts a middle portion of the bushing.

In some configurations of the compressor of any of the above paragraphs, the hub contacts the bushing only at the convex portion.

In another form, the present disclosure provides a compressor that may include a non-orbiting scroll, an orbiting scroll, a driveshaft and a bushing. The non-orbiting scroll includes a first end plate having a first spiral wrap extending therefrom. The orbiting scroll includes a second end plate having a first side and a second side. The first side has a second spiral wrap extending therefrom and meshingly engaged with the first spiral wrap of the non-orbiting scroll. The second side has a hub extending therefrom. The driveshaft is drivingly engaged to the orbiting scroll and includes an eccentric crank pin. The bushing may support the driveshaft and may be disposed within the hub of the orbiting scroll. A clearance gap may exist between the hub and the bushing to allow for radial movement of the orbiting scroll relative to the bushing.

In some configurations of the compressor of the above paragraph, the clearance gap extends only partially around an outer circumference of the bushing.

In some configurations of the compressor of either of the above paragraphs, the bushing includes a convex portion that contacts a middle portion of the hub.

In some configurations of the compressor of any of the above paragraphs, the bushing contacts the hub only at the convex portion.

In some configurations of the compressor of any of the above paragraphs, the compressor includes a bearing disposed on the eccentric crank pin of the driveshaft within the hub of the orbiting scroll.

In some configurations of the compressor of any of the above paragraphs, the bearing includes an inner diametrical surface that is shaped to correspond to a shape of an outer diametrical surface of the eccentric crank pin of the driveshaft such that a force acting on the bearing from the eccentric crank pin is evenly distributed along a length of the bearing.

In some configurations of the compressor of any of the above paragraphs, the bushing is disposed between the hub of the orbiting scroll and the bearing.

In some configurations of the compressor of any of the above paragraphs, the hub of the orbiting scroll includes a convex portion that contacts a middle portion of the bushing.

In some configurations of the compressor of any of the above paragraphs, the hub contacts the bushing only at the convex portion.

In some configurations of the compressor of any of the above paragraphs, the compressor includes a bearing disposed on the eccentric crank pin of the driveshaft within the hub of the orbiting scroll.

In some configurations of the compressor of any of the above paragraphs, the bearing includes an inner diametrical surface that is shaped to correspond to a shape of an outer diametrical surface of the eccentric crank pin of the driveshaft such that a force acting on the bearing from the eccentric crank pin is evenly distributed along a length of the bearing.

In some configurations of the compressor of any of the above paragraphs, the bushing is disposed between the hub of the orbiting scroll and the bearing.

In some configurations of the compressor of any of the above paragraphs, the bearing is needle bearing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
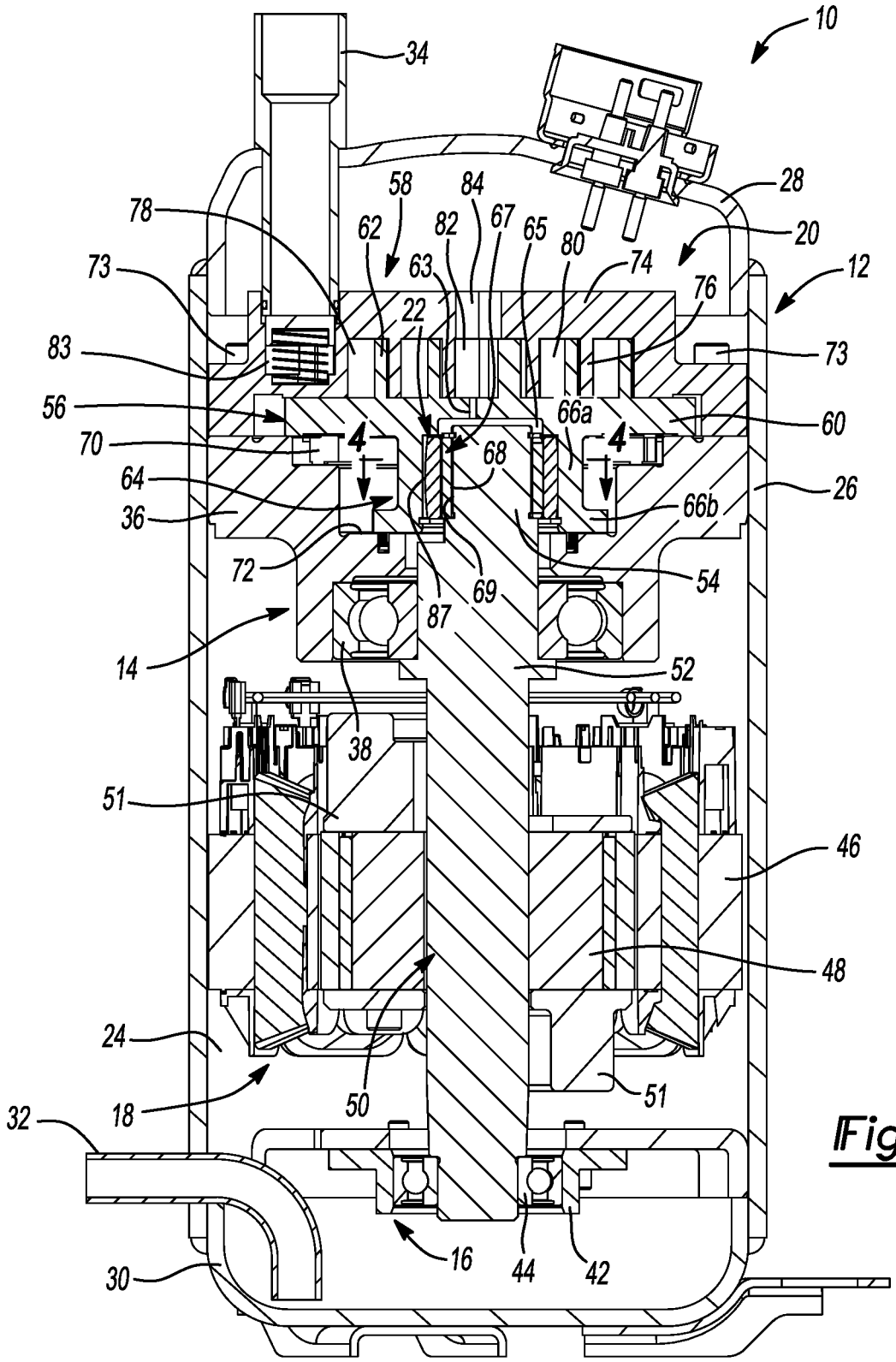
FIG. 1 is a cross-sectional view of a compressor having a bushing according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a compressor 10 is provided (FIG. 1). The compressor 10 may be a high-side scroll compressor including a hermetic shell assembly 12, first and second bearing assemblies 14, 16, a motor assembly 18, a compression mechanism 20 and a drive bushing 22.

As shown in FIG. 1, the shell assembly 12 may define a high-pressure discharge chamber 24 (containing high-pressure working fluid that has been compressed by and discharged from the compression mechanism 20) and may include a cylindrical shell 26, a first end cap 28 at one end thereof, and a base or second end cap 30 at another end thereof. High-pressure working fluid in the discharge chamber may exit the compressor 10 through a discharge fitting 32 attached to the shell assembly 12 (e.g., at the shell 26 or either end cap 28, 30). A suction-inlet conduit 34 may be attached to the shell assembly 12 (e.g., at the first end cap 28) and may extend through the discharge chamber 24 to provide suction-pressure (low-pressure) working fluid to the compression mechanism 20. Suction-pressure fluid within the suction-inlet conduit 34 may be fluidly isolated or sealed off from the discharge chamber 24.

The first and second bearing assemblies 14, 16 may be disposed entirely within the discharge chamber 24. The first bearing assembly 14 may include a first bearing housing 36 and a first bearing 38. The first bearing housing 36 may be fixed to the shell assembly 12. The first bearing housing 36 houses the first bearing 38. The second bearing assembly 16 may include a second bearing housing 42 and a second bearing 44. The second bearing housing 42 is fixed to the shell assembly 12 and supports the second bearing 44.

As shown in FIG. 1, the motor assembly 18 may be disposed entirely within the discharge chamber 24 and may include a motor stator 46, a rotor 48 and a driveshaft 50. The stator 46 may be fixedly attached (e.g., by press-fit) to the shell 26. The rotor 48 may be press fit on the driveshaft 50 and may transmit rotational power to the driveshaft 50. In some configurations, a counterweight 51 may be coupled to each side of the rotor 48. The driveshaft 50 may include a main body 52 and an eccentric crank pin 54 extending from an axial end of the main body 52. The main body 52 may be received in the first and second bearings 38, 42 and may be rotatably supported by the first and second bearing assemblies 14, 16. The first and second bearings 38, 42 may define a rotational axis of the driveshaft 50. The crank pin 54 may engage the compression mechanism 20.

The compression mechanism 20 may be disposed entirely within the discharge chamber 24 and may include an orbiting scroll 56 and a non-orbiting scroll 58. The orbiting scroll 56 may include an end plate 60 having a spiral wrap 62 extending from a first side of the end plate 60. An annular hub 64 may extend from a second side of the end plate 60 and may include a cavity 65, an axially extending portion **66*a* and a radially extending portion 66*b*. A drive bearing 67, the crank pin 54 and the drive bushing 22 may be disposed (FIGS. 1 and 2) within the cavity 65 of the annular hub 64. The drive bearing 67 may be disposed on the eccentric crank pin 54 within the cavity 65 of the annular hub 64 and may include a diametrical surface 68 that is shaped to correspond to the shape of an outer diametrical surface 69 of the crank pin 54. In this way, a force acting on the drive bearing 67 from the eccentric crank pin 54 may be evenly distributed along a length of the drive bearing 67. A clip 71*a* is disposed around a periphery of the eccentric crank pin 54 to restrict the drive bearing 67 from moving upward in the axial direction. A ledge 71*b* of the body 52 of the driveshaft 50 restricts the drive bearing 67** from moving downward in the axial direction.

The radially extending portion **66*b* may extend radially outwardly from an axial end of the axially extending portion 66*a* and engage a sealing member 75 received in a groove 79 formed in a lower surface 72 of the first bearing housing 36. In this way, a biasing chamber 77 defined between the first bearing housing 36, the non-orbiting scroll 58 and the orbiting scroll 56 and containing an intermediate pressure fluid is sealed from the discharge chamber 24. Intermediate-pressure working fluid within the biasing chamber 77 may axially bias the orbiting scroll 56 towards the non-orbiting scroll 58**.

Figure 2:
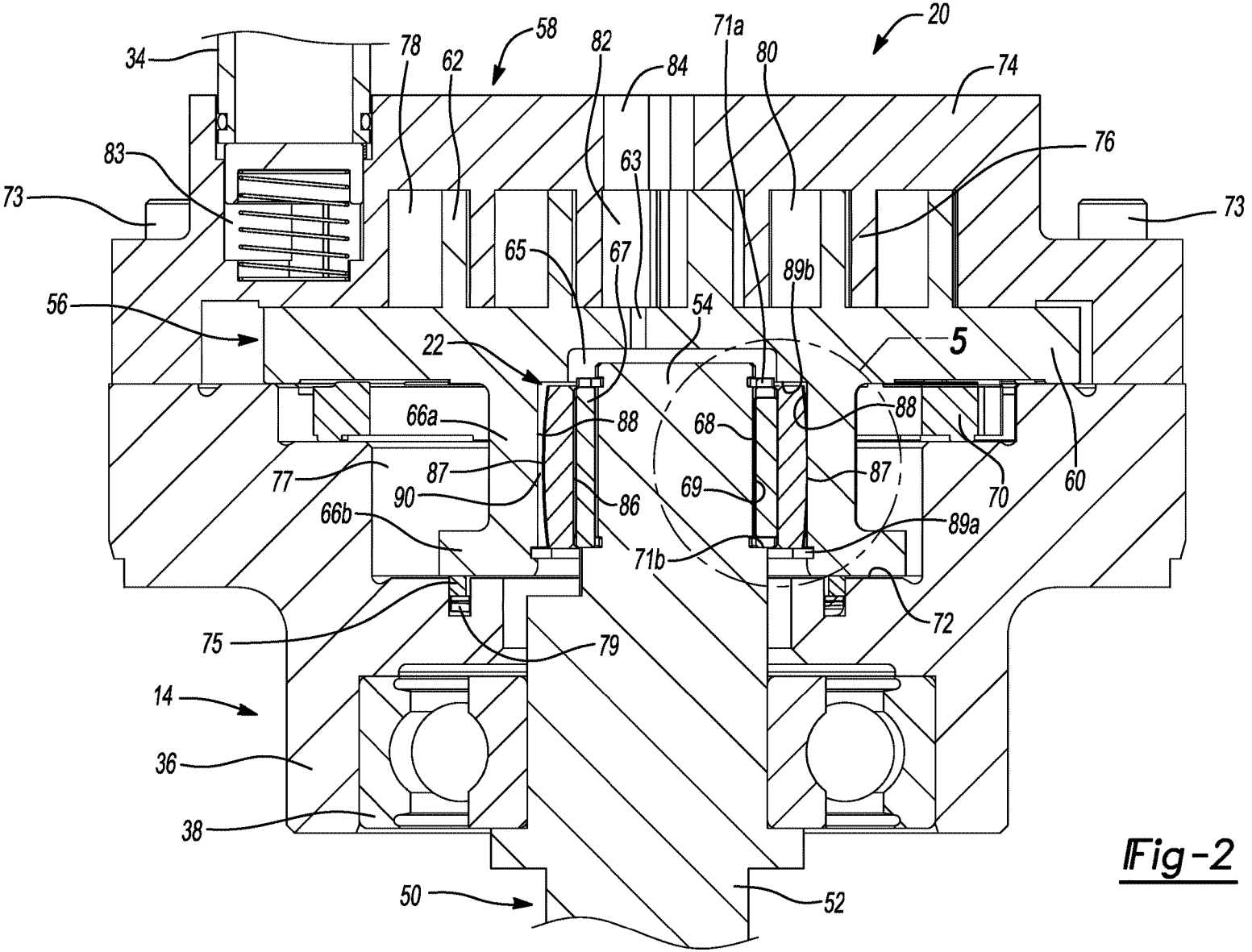
FIG. 2 is a partial cross-sectional view of the compressor of FIG. 1.

As shown in FIGS. 1 and 2, an Oldham coupling 70 may be engaged with the end plate 60 and either the non-orbiting scroll 58 or the first bearing housing 36 to prevent relative rotation between the orbiting scroll 56 and the non-orbiting scroll 58. The annular hub 64 may be axially supported by the sealing member 75.

As shown in FIGS. 1 and 2, the non-orbiting scroll 58 may be attached to the first bearing housing 36 via fasteners 73 (e.g., bolts) and may include an end plate 74 and a spiral wrap 76 projecting from the end plate 74. The spiral wrap 76 may meshingly engage the spiral wrap 62 of the orbiting scroll 56, thereby creating a series of moving fluid pockets (compression pockets) therebetween. The fluid pockets defined by the spiral wraps 62, 76 may decrease in volume as they move from a radially outermost position 78 to a radially intermediate position 80 to a radially innermost position 82 throughout a compression cycle of the compression mechanism 20. The suction-inlet conduit 34 is fluidly coupled with a suction inlet 83 in the end plate 74 and provides suction-pressure working fluid to the fluid pockets at the radially outermost position 78. The end plate 74 of the non-orbiting scroll 58 may include a discharge passage 84. The discharge passage 84 may be in communication with the fluid pocket at the radially innermost position 82. The discharge passage 84 may be in communication with the discharge chamber 24 and provide compressed working fluid to the discharge chamber 24. In some configurations, a lubricant passage 63 may be formed in the end plate 60 and may provide lubricant to the drive bushing 22 and drive bearing 67 from the fluid pocket at a radially innermost position 82.

The drive bushing 22 may be received within the cavity 65 of the annular hub 64 between the axially extending portion 66*a* of the annular hub 64 and the drive bearing 67. A profile of the drive bushing 22 may be shaped such that an inner diametrical surface 86 of the bushing 22 is straight (or constant) and at least a portion of an outer diametrical surface 87 of the bushing 22 is curved or convex such that only a portion (e.g., a middle portion of the outer diametrical surface 87 of the bushing 22) of the outer diametrical surface 87 of the bushing 22 contacts a middle portion of a straight (or constant) shaped inner diametrical surface 88 of the axially extending portion 66*a* of the annular hub 64. That is, the outer diametrical surface 87 curves radially outward as it extends axially from the axial ends of the bushing 22 toward a central portion of the bushing 22 (i.e., a middle or intermediate portion of the bushing 22 has a larger outer diameter than at the axial ends). In this way, the load of the compression mechanism 20 during operation of the compressor 10 is applied to the center of the drive bearing 67 thereby providing for efficient operation of the compressor 10. That is, loading the drive bearing 67 toward the axial ends (i.e., off-center) causes problems with the loading effect on the bearing 67, which ultimately effects performance of the compressor 10.

A clip 89*a* is received in a groove (not shown) formed in the axially extending portion 66*a* of the annular hub 64 to restrict the drive bushing 22 from moving downward in the axial direction. A ledge 89*b* of the end plate 60 of the orbiting scroll 56 restricts the drive bushing 22 from moving upward in the axial direction.

Figure 4:
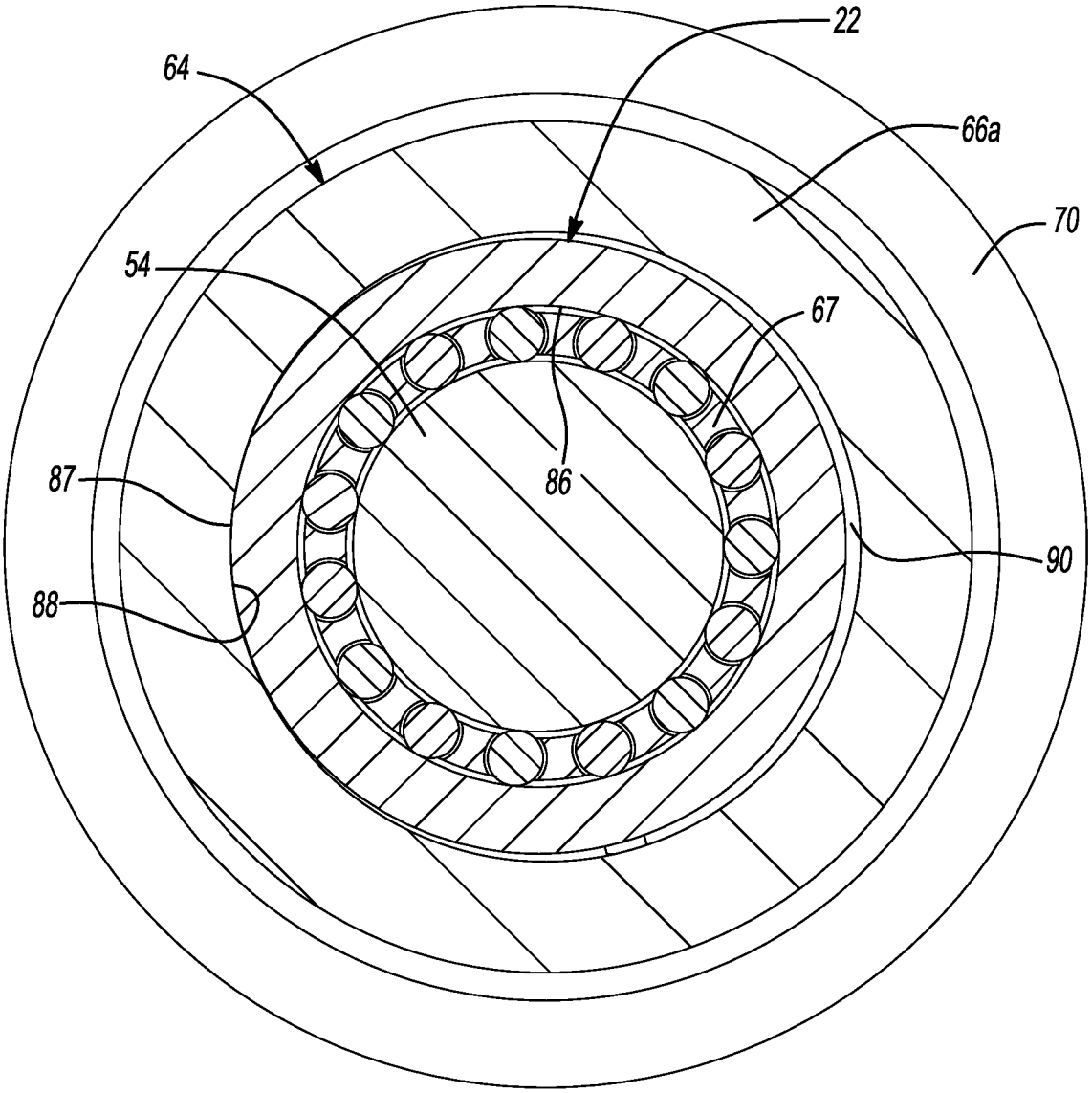
FIG. 4 is a cross-sectional view of the orbiting scroll of the compression mechanism, the bushing and a drive bearing taken along line 4-4 of FIG. 1.
Figure 5:
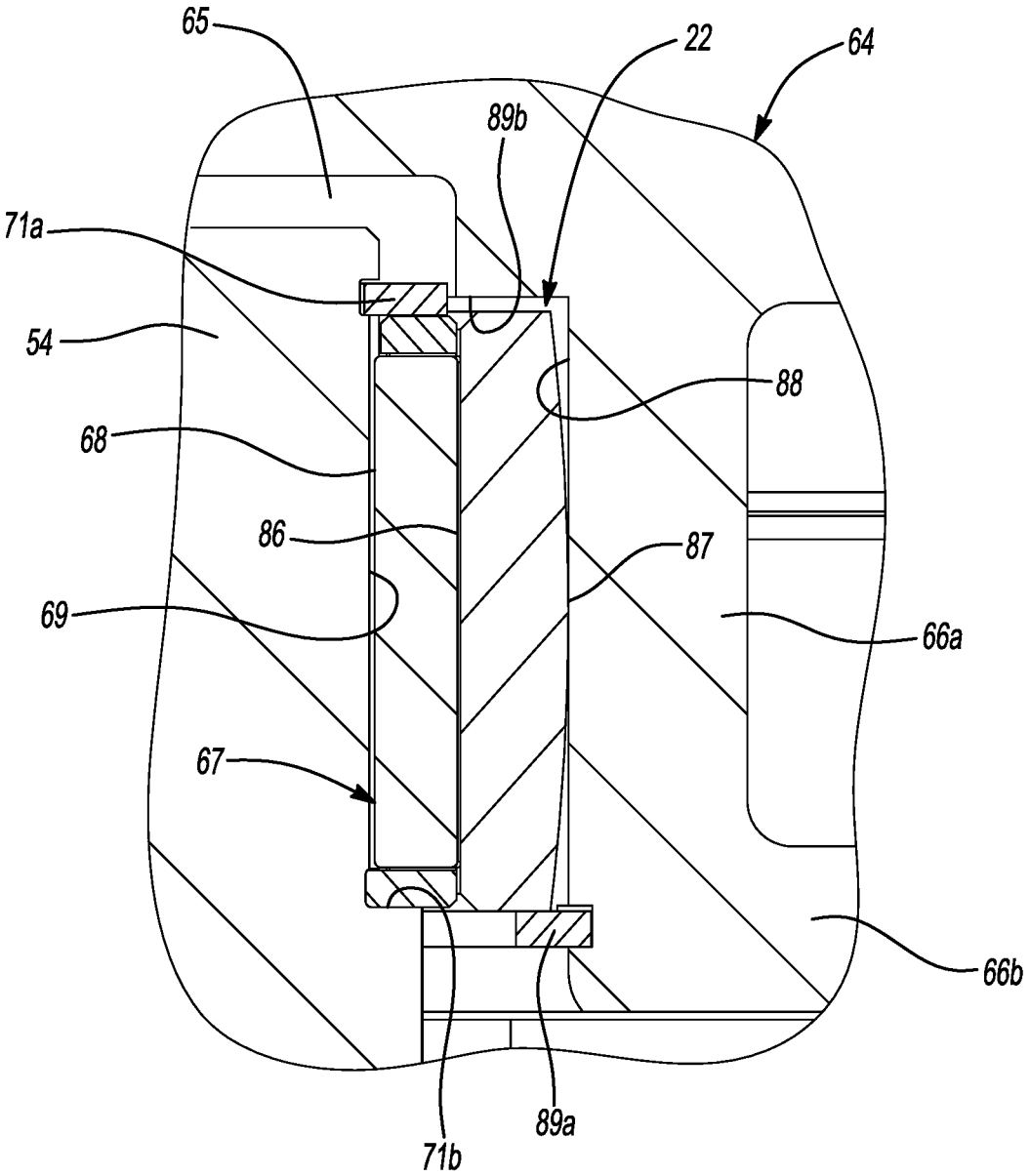
FIG. 5 is a cross-sectional view of a portion of the compressor indicated as area 5 in FIG. 2.

As shown in FIGS. 2 and 4, a space or clearance gap 90 may also exist between the inner diametrical surface 88 of the axially extending portion 66*a* of the annular hub 64 and the outer diametrical surface 87 of the drive bushing 22 (the gap 90 extends only partially around the outer diametrical surface 87) to allow the orbiting scroll 56 to be radially compliant. That is, when an incompressible substance (such as solid impurities, lubricant and/or liquid refrigerant) enters one or more of the fluid pockets between the spiral wraps 62, 76 of the orbiting scroll and the non-orbiting scroll 56, 58, respectively, the orbiting scroll 56 can move in the radial direction relative to the non-orbiting scroll 58 to temporarily separate the spiral wraps 62, 76 from each other, thereby preventing damage to the spiral wraps 62, 76. As shown in FIG. 4, the clearance gap 90 is widest 180 degrees from the contact point between the outer diametrical surface 87 of the bushing 22 and the inner diametrical surface 88 of the axially extending portion 66*a*, and gets narrower the closer it gets toward the contact point between the outer diametrical surface 87 of the bushing 22 and the inner diametrical surface 88 of the axially extending portion 66*a*.

Figure 3:
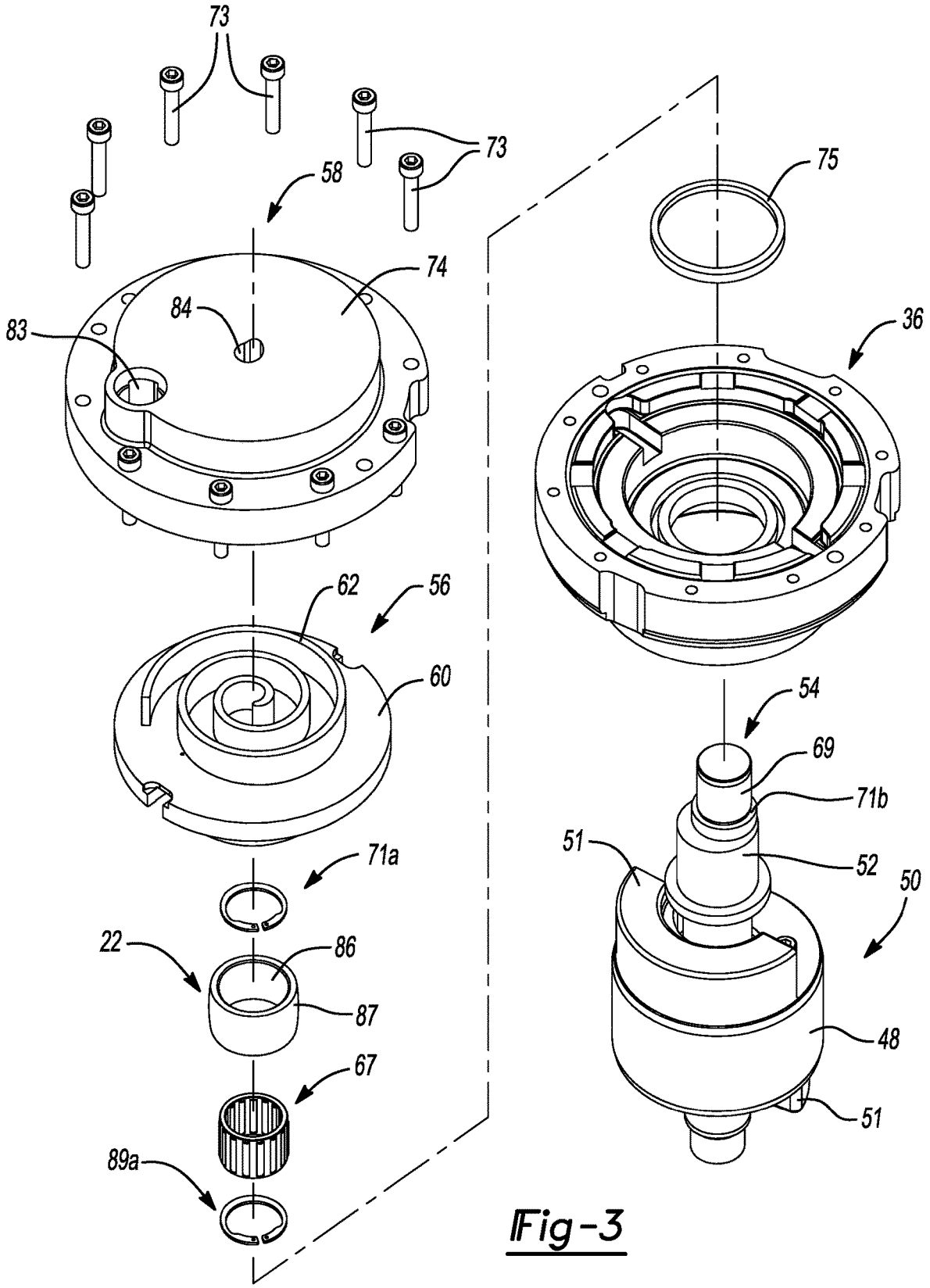
FIG. 3 is an exploded view of a compression mechanism, a motor assembly, a bearing assembly and the bushing of the compressor of FIG. 1.

In some configurations, where the drive bearing 67 is a needle bearing, as shown in FIGS. 3 and 4, the drive bushing 22 may be made from hardened tool steel, thereby capable of serving as an outer race for the needle bearing.

Figure 6:
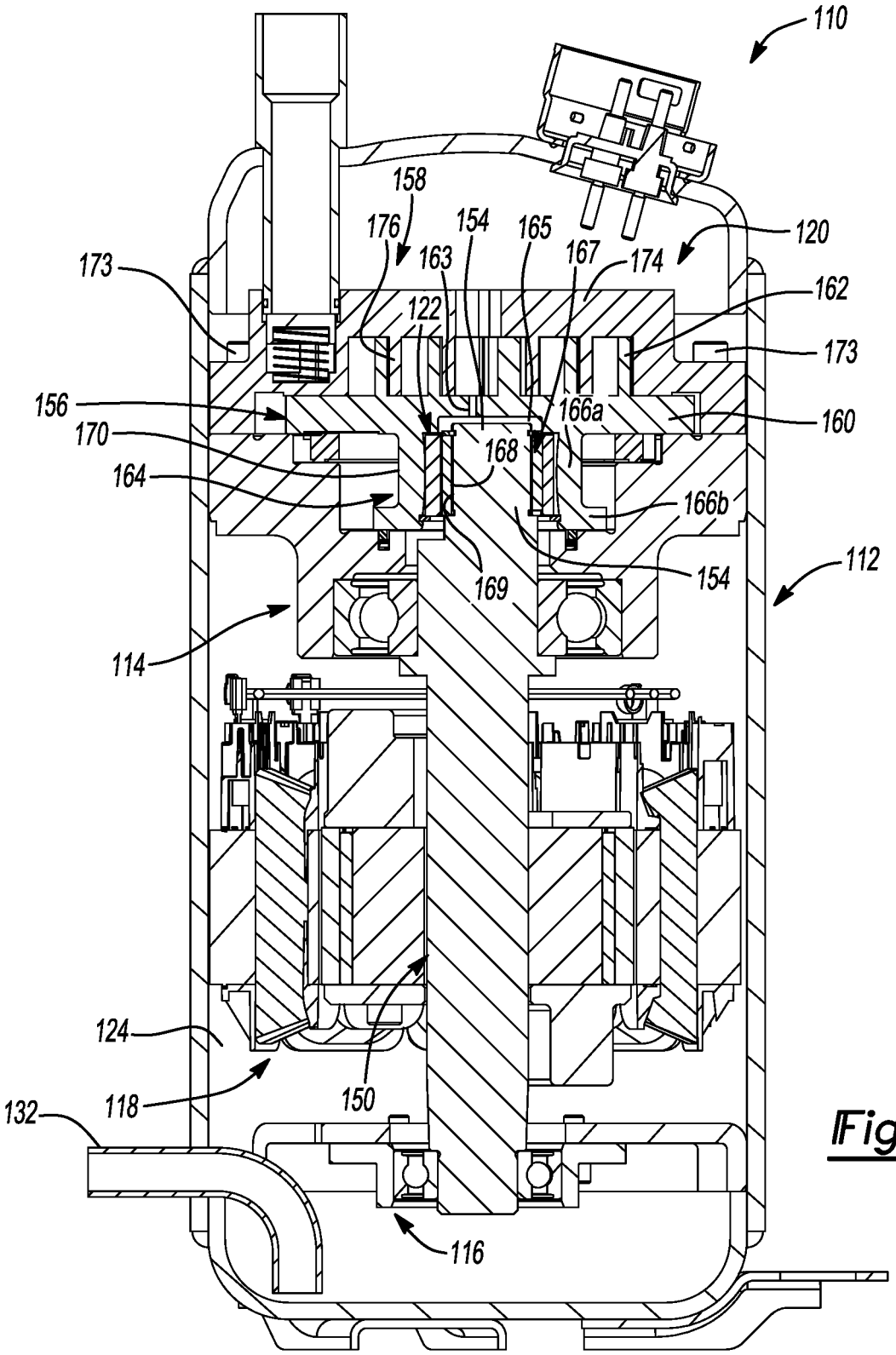
FIG. 6 is a cross-sectional view of another compressor according to the principles of the present disclosure.
Figure 7:
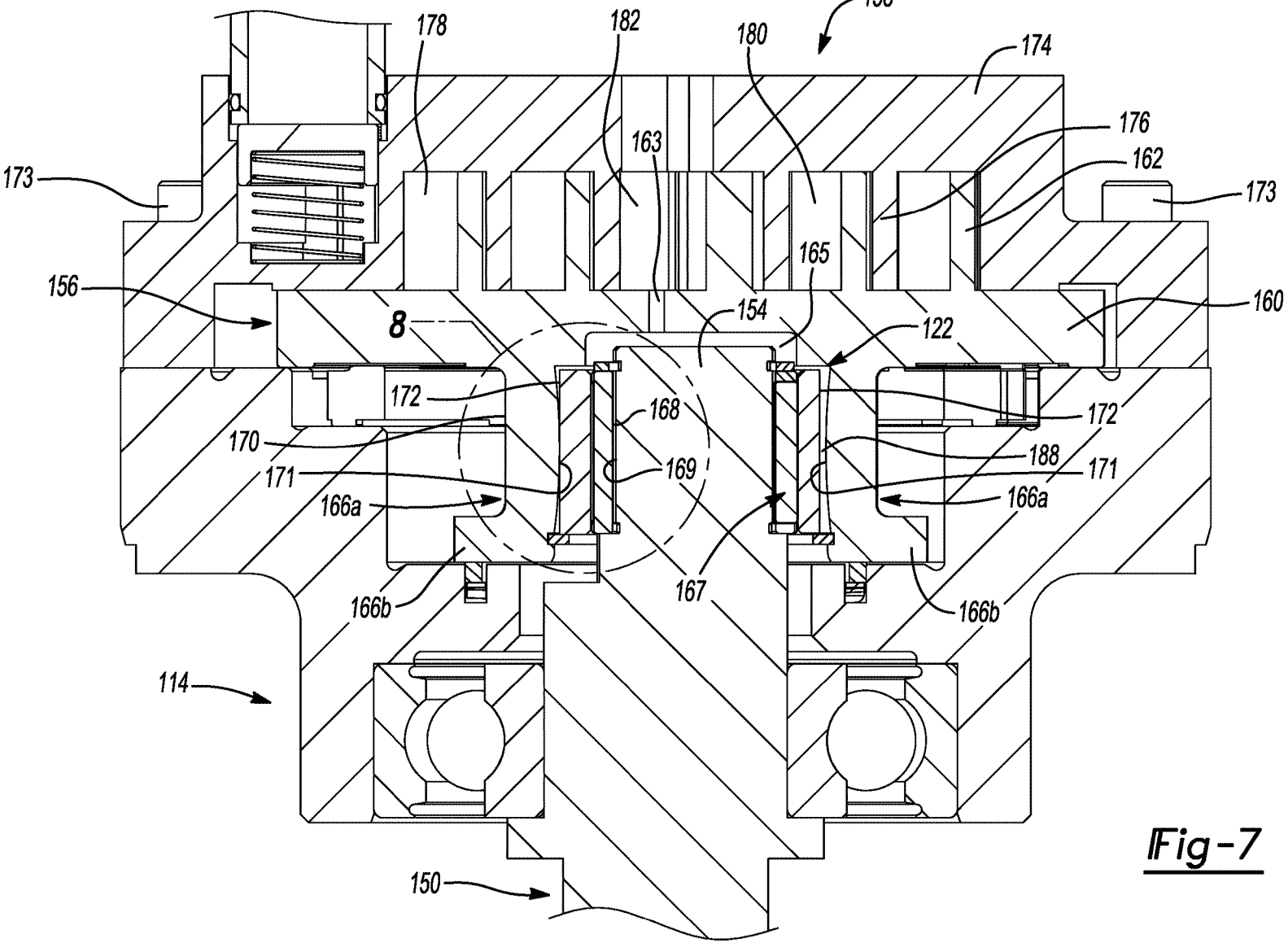
FIG. 7 is a partial cross-sectional view of the compressor of FIG. 6.
Figure 8:
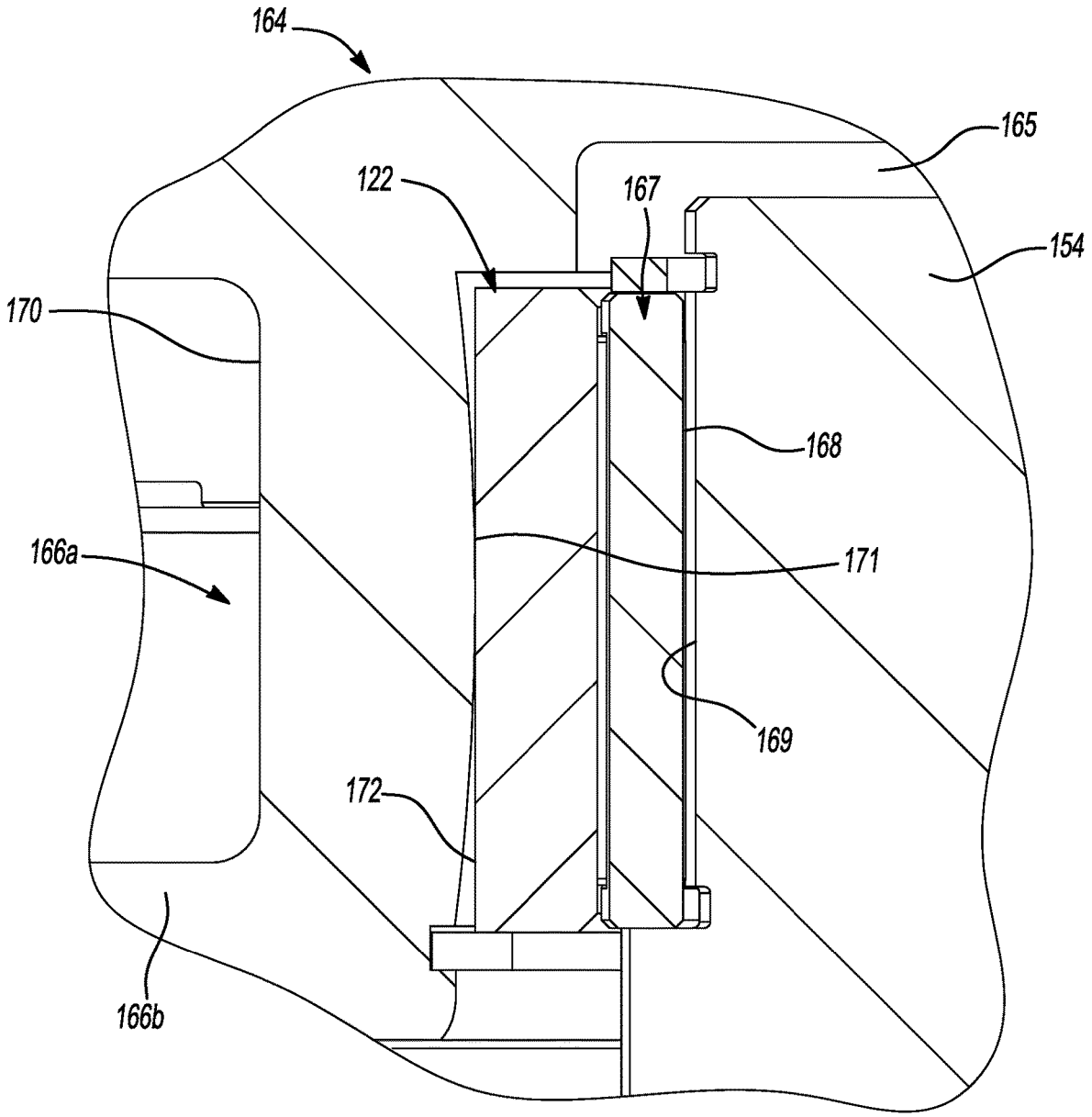
FIG. 8 is a cross-sectional view of a portion of the compressor indicated as area 8 in FIG. 7.

With reference to FIGS. 6-8, another compressor 110 (FIG. 6) is provided. The compressor 110 may be generally similar to the compressor 10 described above, apart from any differences described below. The compressor 110 may be a high-side scroll compressor including a hermetic shell assembly 112, first and second bearing assemblies 114, 116, a motor assembly 118, a compression mechanism 120 and a drive bushing 122. The structure and function of the hermetic shell assembly 112, the first and second bearing assemblies 114, 116 and the motor assembly 118 may be similar or identical to that of the hermetic shell assembly 12, the first and second bearing assemblies 14, 16 and the motor assembly 18, respectively, described above, and therefore, will not be described again in detail.

The compression mechanism 120 may be disposed entirely within a discharge chamber 124 defined by the shell assembly 112 (FIG. 6) and may include an orbiting scroll 156 and a non-orbiting scroll 158. Compressed working fluid may be discharged from the compression mechanism 120 into the discharge chamber 124 and may subsequently exit the compressor 110 through a discharge fitting 132. The orbiting scroll 156 may include an end plate 160 having a spiral wrap 162 extending from a first side of the end plate 160. An annular hub 164 may extend from a second side of the end plate 160 and may include a cavity 165, an axially extending portion 166*a* and a radially extending portion 166*b* extending radially outwardly from an axial end of the axially extending portion 166*a*. A drive bearing 167, an eccentric crank pin 154 of a driveshaft 150 of the motor assembly 118 and the drive bushing 122 may be disposed within the cavity 165. The drive bearing 167 may be disposed on the eccentric crank pin 154 and may include a diametrical surface 168 that is shaped to correspond to the shape of an outer diametrical surface 169 of the crank pin 154. In this way, a force acting on the drive bearing 167 from the eccentric crank pin 154 is evenly distributed along a length of the drive bearing 167. In some configurations, a lubricant passage 163 may be formed in the end plate 160 and may provide lubricant to the drive bushing 122 and drive bearing 167 from a radially innermost fluid pocket.

A profile of the axially extending portion 166*a* may be shaped such than an outer diametrical surface 170 is straight (or constant) and at least a portion of an inner diametrical surface 171 is curved or convex such that only a portion (e.g., a middle portion of the inner diametrical surface 171) of the inner diametrical surface 171 contacts a middle portion of a straight (or constant) outer diametrical surface 172 of the drive bushing 122. That is, the inner diametrical surface 171 of the axially extending portion 166*a* curves radially outward as it extends axially from the axial ends of the toward a central portion of the axially extending portion 166*a* (i.e., a middle or intermediate portion of the axially extending portion 166*a* has a larger outer diameter than at the axial ends). In this way, the load of the compression mechanism 120 during operation of the compressor 110 is applied to the center of the drive bearing 167 thereby providing for efficient operation of the compressor 110. That is, loading the drive bearing 167 toward the axial ends (i.e., off-center) causes problems with the loading effect on the bearing 167, which ultimately effects performance of the compressor 110.

The non-orbiting scroll 158 may be attached to the first bearing assembly 114 via fasteners 173 (e.g., bolts) and may include an end plate 174 and a spiral wrap 176 projecting from the end plate 174. The spiral wrap 176 may meshingly engage the spiral wrap 162 of the orbiting scroll 156, thereby creating a series of moving fluid pockets therebetween. The fluid pockets defined by the spiral wraps 162, 176 may decrease in volume as they move from a radially outermost position 178 to a radially intermediate position 180 to a radially innermost position 182 throughout a compression cycle of the compression mechanism 120.

The drive bushing 122 may be received within the cavity 165 of the annular hub 164 between the axially extending portion 166*a* of the annular hub 164 and the drive bearing 167. A space or clearance gap 188 (FIG. 7) may also exist between the inner diametrical surface 171 of the axially extending portion 166*a* and the outer diametrical surface 172 of the drive bushing 122 (the gap 188 extends only partially around the inner diametrical surface 171 of the axially extending portion 166*a*) to allow the orbiting scroll 156 to be radially compliant. That is, when an incompressible substance (such as solid impurities, lubricant and/or liquid refrigerant) enters one or more of the fluid pockets between the spiral wraps 162, 176 of the orbiting scroll and the non-orbiting scroll 156, 158, respectively, the orbiting scroll 156 can move in the radial direction relative to the non-orbiting scroll 158 to temporarily separate the spiral wraps 162, 176 from each other, thereby preventing damage to the spiral wraps 162, 176.

The clearance gap 188 is widest 180 degrees from the contact point between the inner diametrical surface 171 of the axially extending portion 166*a* and the outer diametrical surface 172 of the drive bushing 122, and gets narrower the closer it gets toward the contact point between the inner diametrical surface 171 of the axially extending portion 166*a* and the outer diametrical surface 172 of the drive bushing 122.

While the compressors 10, 110 are described above as being high-side compressors (i.e., with the bearing assemblies, motor assembly, and compression mechanism disposed in the discharge chamber), it will be appreciated that the principles of the present disclosure are also applicable to low-side compressors. That is, the bearing assemblies, motor assembly, and compression mechanism of either of the compressors 10, 110 could be disposed in a suction chamber that is separated from a discharge chamber by a partition.

Figure 9:
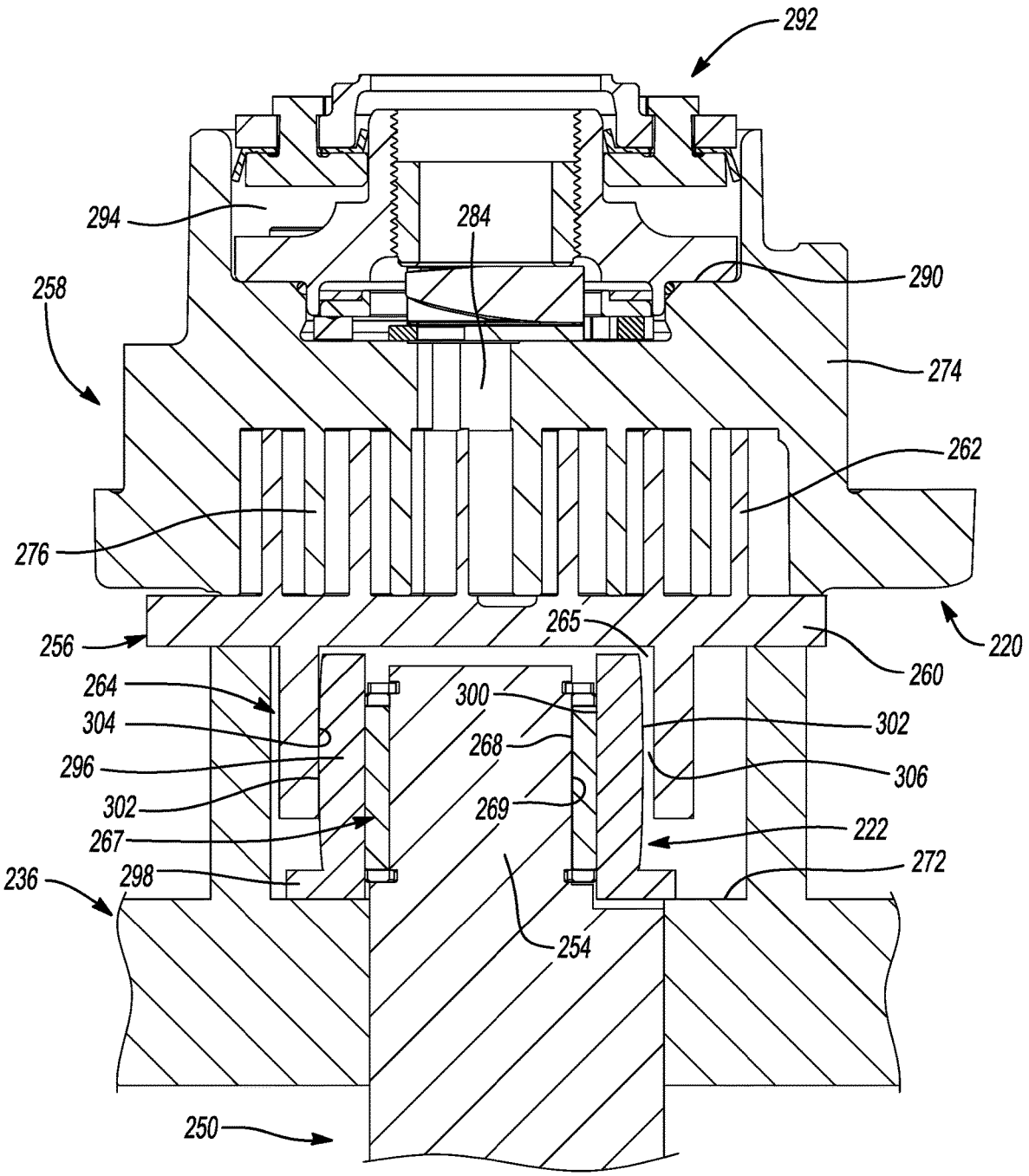
FIG. 9 is a cross-sectional view of another compression member and drive bushing according to the principles of the present disclosure.

With reference to FIG. 9, a bearing housing 236, a driveshaft 250, a compression mechanism 220 and a drive bushing 222 are provided. The bearing housing 236, the driveshaft 250, the compression mechanism 220 and the drive bushing 222 may be incorporated into a low-side compressor (not shown). The structure and function of the bearing housing 236 may be similar or identical to that of the bearing housing 36 described above, and therefore, will not be described again in detail. The structure and function of the driveshaft 250 may be similar or identical to that of drive shafts 50, 150 described above, and therefore, will not be described again in detail.

The compression mechanism 220 is supported by the bearing housing 236. The compression mechanism 220 includes an orbiting scroll 256 and a non-biting scroll 258. The orbiting scroll 256 may include an end plate 260 having a spiral wrap 262 extending from a first side of the end plate 260. An annular hub 264 may extend from a second side of the end plate 260. A drive bearing 267, an eccentric crank pin 254 of the driveshaft 250 and the drive bushing 222 may be disposed within a cavity 265 of the annular hub 264. The drive bearing 267 may be disposed on the eccentric crank pin 254 within the cavity 265 of the annular hub 264 and may include a diametrical surface 268 that is shaped to correspond to the shape of an outer diametrical surface 269 of the crank pin 254. In this way, a force acting on the drive bearing 267 from the eccentric crank pin 254 is evenly distributed along a length of the drive bearing 267.

The non-orbiting scroll 258 may include an end plate 274 and a spiral wrap 276 projecting from the end plate 274. The spiral wrap 276 may meshingly engage the spiral wrap 262 of the orbiting scroll 256, thereby creating a series of moving fluid pockets (compression pockets) therebetween. The fluid pockets defined by the spiral wraps 262, 276 may decrease in volume as they move from a radially outermost position to a radially intermediate position to a radially innermost position throughout a compression cycle of the compression mechanism 220. The end plate 274 of the non-orbiting scroll 258 may include a discharge passage 284. The discharge passage 284 may be in communication with the fluid pocket at the radially innermost position. The discharge passage 284 may be in communication with the discharge chamber (not shown) and provide compressed working fluid to the discharge chamber (not shown).

The non-orbiting scroll 258 may also include an annular recess 290 in the upper surface thereof having parallel coaxial side walls in which an annular floating seal assembly 292 is sealingly disposed for relative axial movement. The floating seal assembly 292 defines an axial biasing chamber 294 in the annular recess 290. The axial biasing chamber 294 is in communication with one of the series of moving compression pockets at an intermediate pressure via a passageway (not shown). Intermediate-pressure working fluid within the axial biasing chamber 294 may axially bias the non-orbiting scroll 258 towards the orbiting scroll 256.

The drive bushing 222 may be disposed within the annular hub 264. The drive bushing 222 may be an annular member having a first member 296 (e.g., an axially extending portion) and a second member 298 (e.g., a radially extending portion). The first member 296 may be disposed axially within the hub 264 between the hub 264 and the drive bearing 267. A profile of the first member 296 may be shaped such than an inner diametrical surface 300 is straight (or constant) and at least a portion of an outer diametrical surface 302 is curved or convex such that only a portion (e.g., a middle portion of the outer diametrical surface 302) of the outer diametrical surface 302 contacts a middle portion of a straight (or constant) shaped inner diametrical surface 304 of the hub 264. That is, the outer diametrical surface 302 of the first member 296 curves radially outward as it extends axially from the axial ends toward a central portion of the first member 296 (i.e., a middle or intermediate portion of the first member 296 has a larger outer diameter than at the axial ends). In this way, the load of the compression mechanism 220 during operation of the compressor (not shown) is applied to the center of the drive bearing 267 thereby providing for reliable operation of the compressor (not shown). That is, loading the drive bearing 267 toward the axial ends (i.e., off-center) causes problems with the loading effect on the bearing 267, which ultimately effects reliability of the compressor.

A space or clearance gap 306 may also exist between the outer diametrical surface 302 of the first member 296 and the inner diametrical surface 304 of the hub 264 (the gap 306 extends only partially around the outer diametrical surface 302) to allow the orbiting scroll 256 to be radially compliant.

The second member 298 may extend radially outwardly from an axial end of the first member 296 and may be disposed between a distal axial end of the hub 264 and a surface 272 of the bearing housing 236.

Figure 10:
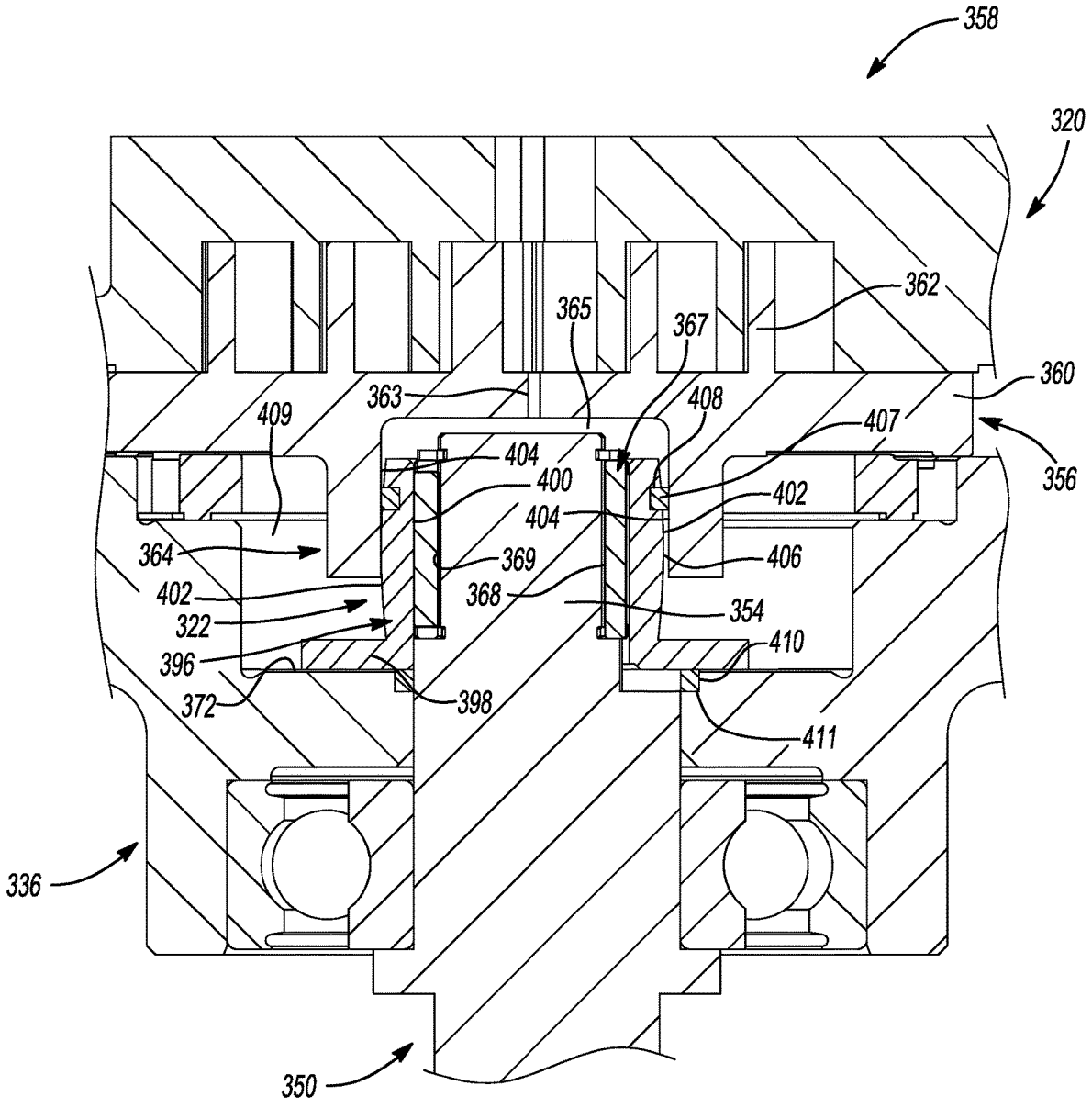
FIG. 10 is a cross-sectional view of yet another compression member and drive bushing according to the principles of the present disclosure.

With reference to FIG. 10, a bearing housing 336, a driveshaft 350, a compression mechanism 320 and a drive bushing 322 are provided. The bearing housing 336, the driveshaft 350, the compression mechanism 320 and the drive bushing 322 may be incorporated into a high-side or low-side compressor (not shown). The bearing housing 336 may be similar or identical to that of the bearing housings 36, 236 described above, and therefore, will not be described again in detail. The structure and function of the driveshaft 350 may be similar or identical to that of drive shafts 50, 150, 250 described above, and therefore, will not be described again in detail.

The compression mechanism 320 includes an orbiting scroll 356 and a non-biting scroll 358. The orbiting scroll 356 may include an end plate 360 having a spiral wrap 362 extending from a first side of the end plate 360. An annular hub 364 may extend from a second side of the end plate 360. A drive bearing 367, an eccentric crank pin 354 of the driveshaft 350 and the drive bushing 322 may be disposed within a cavity 365 of the annular hub 364. The drive bearing 367 may be disposed on the eccentric crank pin 354 within the cavity 365 of the annular hub 364 and may include a diametrical surface 368 that is shaped to correspond to the shape of an outer diametrical surface 369 of the crank pin 354. In this way, a force acting on the drive bearing 367 from the eccentric crank pin 354 is evenly distributed along a length of the drive bearing 367. In some configurations, a lubricant passage 363 may be formed in the end plate 360 and may provide lubricant to the drive bushing 322 and drive bearing 367 from a radially innermost fluid pocket.

The structure and function of the non-orbiting scroll 358 may be similar or identical to that of non-orbiting scrolls 58, 158 described above, and therefore, will not be described again in detail.

The drive bushing 322 may be disposed within the annular hub 364. The drive bushing 322 may be an annular member having a first member 396 (e.g., an axially extending portion) and a second member 398 (e.g., a radially extending portion). The first member 396 may be disposed axially within the hub 364 between the hub 364 and the drive bearing 367. A profile of the first member 396 may be shaped such than an inner diametrical surface 400 is straight (or constant) and at least a portion of an outer diametrical surface 402 is curved or convex such that only a portion (e.g., a middle portion of the outer diametrical surface 402) of the outer diametrical surface 402 contacts a middle portion of a straight (or constant) shaped inner diametrical surface 404 of the hub 364. That is, the outer diametrical surface 402 of the first member 396 curves radially outward as it extends axially from the axial ends toward a central portion of the first member 396 (i.e., a middle or intermediate portion of the first member 396 has a larger outer diameter than at the axial ends). In this way, the load of the compression mechanism 320 during operation of the compressor (not shown) is applied to the center of the drive bearing 367 thereby providing for reliable operation of the compressor (not shown). That is, loading the drive bearing 367 toward the axial ends (i.e., off-center) causes problems with the loading effect on the bearing 367, which ultimately effects reliability of the compressor.

A space or clearance gap 406 may also exist between the outer diametrical surface 402 of the first member 396 and the inner diametrical surface 404 of the hub 364 (the gap 406 extends only partially around the outer diametrical surface 402) to allow the orbiting scroll 356 to be radially compliant. A sealing member 407 may be disposed in a groove 408 formed in one of the first member 396 and the hub 364 and engaging the other of the first member 396 and the hub 364 thereby, sealing a biasing chamber 409 (containing an intermediate pressure fluid) defined between the bearing housing 336, the non-orbiting scroll 358 and the orbiting scroll 356.

The second member 398 may extend radially outwardly from an axial end of the first member 396 and may be disposed between a distal axial end of the hub 364 and a lower surface 372 of the bearing housing 336. The second member 398 may engage a sealing member 410 received in a groove 411 formed in the lower surface 372 of the bearing housing 336 further sealing the biasing chamber 409 from a discharge chamber (not shown).

Figure 11:
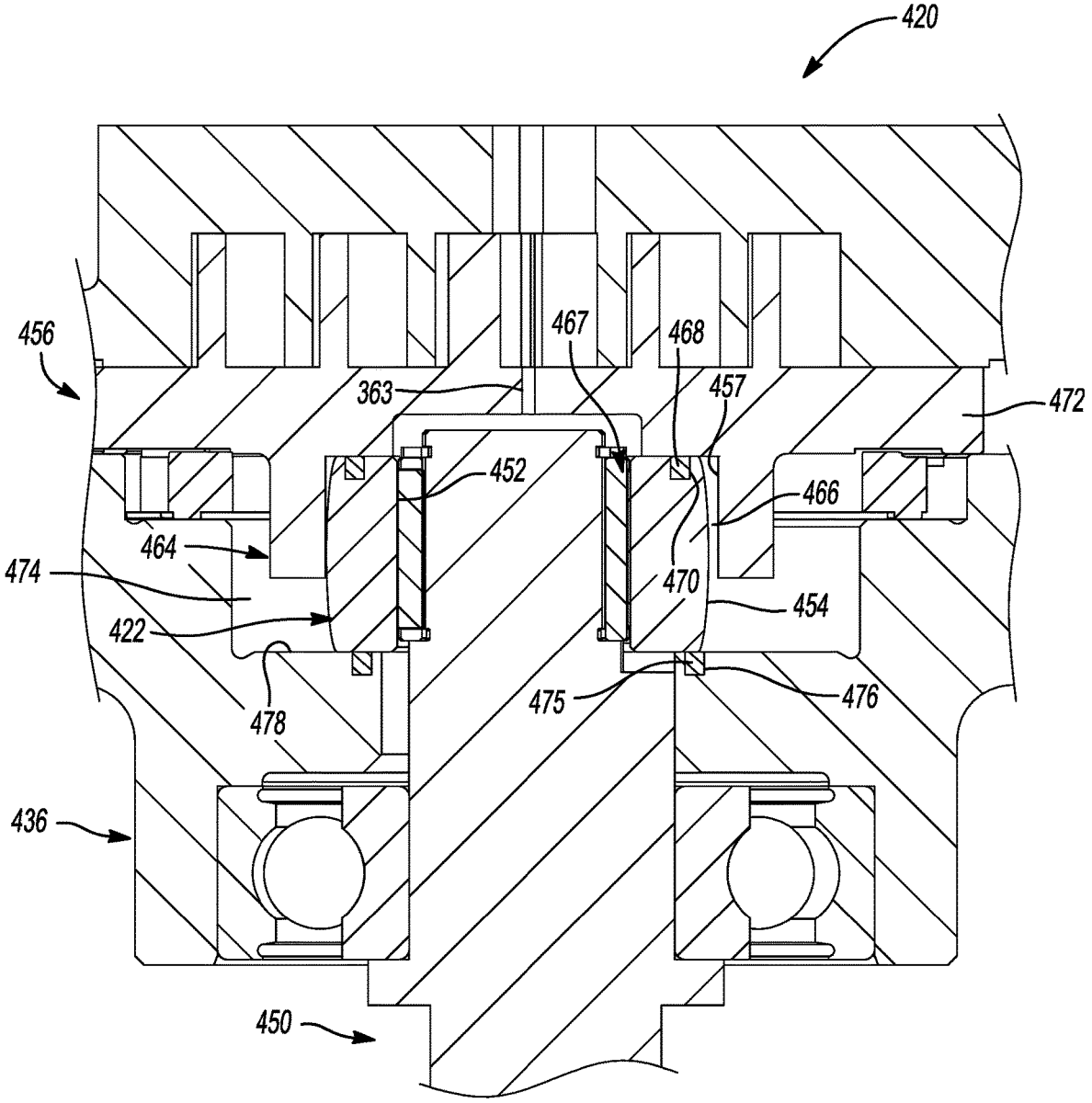
FIG. 11 is a cross-sectional view of yet another compression member and drive bushing according to the principles of the present disclosure.

With reference to FIG. 11, a bearing housing 436, a driveshaft 450, a compression mechanism 420 and a drive bushing 422 are provided. The bearing housing 436, the driveshaft 450, the compression mechanism 420 and the drive bushing 422 may be incorporated into a high-side or low-side compressor (not shown). The bearing housing 436 may be similar or identical to that of the bearing housings 36, 236, 336 described above, and therefore, will not be described again in detail. The structure and function of the driveshaft 450 may be similar or identical to that of drive shafts 50, 150, 250, 350 described above, and therefore, will not be described again in detail.

The structure and function of the compression mechanism 420 may be similar or identical to that of compression mechanism 320 described above, and therefore, will not be described again in detail.

The drive bushing 422 may be disposed axially within an annular hub 464 of an orbiting scroll 456 of the compression mechanism 420 between the hub 464 and a drive bearing 467. A profile of the drive bushing 422 may be shaped such than an inner diametrical surface 452 is straight (or constant) and at least a portion of an outer diametrical surface 454 is curved or convex such that only a portion (e.g., a middle portion of the outer diametrical surface 454) of the outer diametrical surface 454 contacts a middle portion of a straight (or constant) shaped inner diametrical surface 457 of the hub 464. That is, the outer diametrical surface 454 of the drive bushing 422 curves radially outward as it extends axially from the axial ends toward a central portion of the drive bushing 422 (i.e., a middle or intermediate portion of the drive bushing 422 has a larger outer diameter than at the axial ends). In this way, the load of the compression mechanism 420 during operation of the compressor (not shown) is applied to the center of the drive bearing 467 thereby providing for reliable operation of the compressor (not shown). That is, loading the drive bearing 467 toward the axial ends (i.e., off-center) causes problems with the loading effect on the bearing 467, which ultimately effects reliability of the compressor.

A space or clearance gap 466 may also exist between the outer diametrical surface 454 of the drive bushing 422 and the inner diametrical surface 457 of the hub 464 (the gap 466 extends only partially around the outer diametrical surface 454) to allow the orbiting scroll 456 to be radially compliant. A sealing member 468 may be disposed in a groove 470 formed in the drive bushing 422 and engaging an end plate 472 of the orbiting scroll 456 of the compression mechanism 420, thereby sealing a biasing chamber 474 (containing an intermediate pressure fluid) defined between the bearing housing 436, the non-orbiting scroll 458 and the orbiting scroll 456 from a discharge chamber (not shown) of the compressor (not shown).

The drive bushing 422 may also engage a sealing member 475 received in a groove 476 formed in a lower surface 478 of the bearing housing 436 to further seal the biasing chamber 474 from the discharge chamber.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a non-orbiting scroll including a first end plate having a first spiral wrap extending therefrom;

an orbiting scroll including a second end plate having a first side and a second side, the first side having a second spiral wrap extending therefrom and meshingly engaged with the first spiral wrap of the non-orbiting scroll, the second side having a hub extending therefrom;

a driveshaft including an eccentric crank pin drivingly engaging the orbiting scroll, wherein an entire outer diametrical surface of the crank pin is curved;

a bearing surrounding the crank pin and disposed within the hub of the orbiting scroll; and a bushing disposed within the hub of the orbiting scroll and surrounding the bearing such that the bearing is disposed radially between the crank pin and the bushing, wherein a diametrical surface of one of the hub and the bushing includes a convex portion that contacts a portion of a diametrical surface of the other of the hub and the bushing, and wherein the portion of the diametrical surface of the other of the hub and the bushing is straight.

2. The compressor of claim 1, wherein the diametrical surface that includes the convex portion is an outer diametrical surface of the bushing, and wherein the convex portion contacts a middle portion of an inner diametrical surface of the hub.

3. The compressor of claim 2, wherein the bushing is disposed between the hub of the orbiting scroll and the driveshaft.

4. The compressor of claim 3, wherein a clearance gap exists between the hub and the bushing.

5. The compressor of claim 4, further comprising a bearing housing including an annular recess formed in a surface thereof, and wherein a sealing member is received in the annular recess.

6. The compressor of claim 5, wherein the bushing includes an axially extending portion and a radially extending portion, and wherein the convex portion is formed on the axially extending portion of the bushing.

7. The compressor of claim 6, wherein the axially extending portion is disposed within the hub of the orbiting scroll between the hub and the driveshaft, and wherein the radially extending portion extends radially from an axial end of the axially extending portion and is disposed between an axial end of the hub and the surface of the bearing housing.

8. The compressor of claim 7, wherein the radially extending portion of the bushing engages the sealing member to seal a biasing chamber defined by the orbiting scroll, the non-orbiting scroll and the bearing housing.

9. The compressor of claim 8, wherein one of the axially extending portion and the hub includes an annular recess formed in a surface thereof, and wherein a sealing member is received in the annular recess.

10. The compressor of claim 9, wherein the other of the axially extending portion and the hub engages the sealing member to further seal the biasing chamber.

11. The compressor of claim 5, wherein the bushing engages the sealing member to seal a biasing chamber defined by the orbiting scroll, the non-orbiting scroll and the bearing housing.

12. The compressor of claim 11, wherein the bushing includes an annular recess formed in a surface thereof, and wherein a sealing member is received in the annular recess.

13. The compressor of claim 12, wherein the second end plate of the orbiting scroll engages the sealing member to further seal the biasing chamber.

14. The compressor of claim 1, wherein the diametrical surface that includes the convex portion is an inner diametrical surface of the hub of the orbiting scroll, and wherein the convex portion contacts a middle portion of an outer diametrical surface of the bushing.

15. The compressor of claim 14, wherein the bushing is disposed between the hub of the orbiting scroll and the driveshaft.

16. The compressor of claim 15, wherein a clearance gap exists between the hub and the bushing.

17. A compressor comprising:

a non-orbiting scroll including a first end plate having a first spiral wrap extending therefrom;

an orbiting scroll including a second end plate having a first side and a second side, the first side having a second spiral wrap extending therefrom and meshingly engaged with the first spiral wrap of the non-orbiting scroll, the second side having a hub extending therefrom;

a driveshaft drivingly engaged to the orbiting scroll and including an eccentric crank pin, wherein an entire outer diametrical surface of the crank pin is curved;

a bearing surrounding the crank pin and disposed within the hub of the orbiting scroll; and a bushing disposed within the hub of the orbiting scroll and surrounding the bearing such that the bearing is disposed radially between the crank pin and the bushing, wherein a diametrical surface of one of the hub and the bushing includes a convex portion that contacts a portion of a diametrical surface of the other of the hub and the bushing, and wherein the portion of the diametrical surface of the other of the hub and the bushing is straight, and wherein a clearance gap exists radially between the hub and the bushing to allow for radial movement of the orbiting scroll relative to the bushing.

18. The compressor of claim 17, wherein the bushing includes an outer diametrical surface having a convex portion, wherein the convex portion contacts a middle portion of an inner diametrical surface of the hub, and wherein the middle portion of the inner diametrical surface is straight.

19. The compressor of claim 17, wherein the bearing includes an inner diametrical surface that is shaped to correspond to a shape of an outer diametrical surface of the eccentric crank pin of the driveshaft.

20. The compressor of claim 19, wherein the bushing is disposed between the hub of the orbiting scroll and the bearing.

21. The compressor of claim 20, wherein the bearing is a needle bearing.

22. The compressor of claim 19, wherein an inner diametrical surface of the hub of the orbiting scroll includes a convex portion, wherein the convex portion contacts a middle portion of an outer diametrical surface of the bushing, and wherein the middle portion of the outer diametrical surface of the bushing is straight.

23. The compressor of claim 17, wherein the bearing is a needle bearing.

* * * * *